US011385009B2

(12) United States Patent
Hudson, III et al.

(10) Patent No.: US 11,385,009 B2
(45) Date of Patent: Jul. 12, 2022

(54) FIREARMS TRIGGER ASSEMBLY

(71) Applicant: Daniel Defense LLC, Black Creek, GA (US)

(72) Inventors: Billie Cyril Hudson, III, Georgetown, TX (US); Lauren Hudson, Georgetown, TX (US); Mark Thomas Hammond, Elizabethtown, KY (US); Marlin Ray Jiranek, II, Elizabethtown, KY (US); David Orla Matteson, Horse Cave, KY (US)

(73) Assignee: DANIEL DEFENSE, LLC, Black Creek, GA (US)

( * ) Notice: Subject to any disclaimer, the term of this patent is extended or adjusted under 35 U.S.C. 154(b) by 255 days.

(21) Appl. No.: 16/595,336

(22) Filed: Oct. 7, 2019

(65) Prior Publication Data

US 2020/0149834 A1 May 14, 2020

Related U.S. Application Data

(63) Continuation of application No. 15/700,758, filed on Sep. 11, 2017, now abandoned.

(60) Provisional application No. 62/398,232, filed on Sep. 22, 2016.

(51) Int. Cl.
*F41A 17/46* (2006.01)
*F41A 19/10* (2006.01)

(52) U.S. Cl.
CPC ..... *F41A 17/46* (2013.01); *F41A 19/10* (2013.01)

(58) Field of Classification Search
CPC ..... F41A 17/46; F41A 19/10
See application file for complete search history.

(56) References Cited

U.S. PATENT DOCUMENTS 580,935 A * 4/1897 Ehbets ..... F41A 19/30 89/144
747,585 A * 12/1903 Browning ..... F41A 17/64 89/148
3,857,322 A * 12/1974 Lichtman ..... F41A 19/48 89/145
4,048,901 A * 9/1977 Ghisoni ..... F41A 3/64 89/132
4,391,058 A * 7/1983 Casull ..... F41A 19/30 42/69.02
4,428,138 A * 1/1984 Seecamp ..... F41A 19/48 42/70.02
4,974,493 A * 12/1990 Yeffman ..... F41A 3/78 89/198
5,355,768 A * 10/1994 Felk ..... F41A 17/36 42/70.06
5,433,028 A * 7/1995 Novak ..... F41A 17/06 42/70.06
5,560,134 A * 10/1996 Van Niekerk ..... F41A 17/46 42/70.06
6,301,816 B1 * 10/2001 Saltz ..... F41A 17/54 42/70.01
6,499,243 B1 * 12/2002 Herzog ..... F41A 17/066 42/70.06
6,519,888 B1 * 2/2003 Oberst ..... F41A 17/04 42/70.06

(Continued)

*Primary Examiner* — Michelle Clement
(74) *Attorney, Agent, or Firm* — Eversheds Sutherland (US) LLP

(57) ABSTRACT

A translational yoked trigger for a firearm has an integral trigger safety.

3 Claims, 4 Drawing Sheets

(56) References Cited

U.S. PATENT DOCUMENTS 6,629,379 B1 * 10/2003 Doiron ..... F41A 17/02 42/70.06
6,843,013 B2 * 1/2005 Cutini ..... F41A 17/46 42/70.01
7,562,479 B2 * 7/2009 Williams ..... F41A 19/16 42/69.03
D597,626 S * 8/2009 Krieger ..... D22/108
7,992,338 B2 * 8/2011 Bowman ..... F41A 19/10 42/90
8,037,632 B2 * 10/2011 Pikielny ..... F41A 17/066 42/70.06
8,220,193 B1 * 7/2012 Lynch ..... F41A 17/82 42/70.08
8,250,799 B2 * 8/2012 Duperry ..... F41A 19/16 42/70.04
9,335,110 B1 * 5/2016 Heizer ..... F41A 3/58
9,383,153 B2 * 7/2016 Nebeker ..... F41A 17/56
9,696,104 B1 * 7/2017 Bloomfield ..... F41A 19/10
10,006,734 B1 * 6/2018 Findlay ..... F41A 19/12
10,060,693 B2 * 8/2018 Bubits ..... F41C 3/00
2001/0039751 A1 * 11/2001 Kurvinen ..... F41A 33/00 42/69.01
2001/0054246 A1 * 12/2001 Guhring ..... F41A 19/16 42/69.03
2003/0213159 A1 * 11/2003 Cutini ..... F41A 17/46 42/70.06
2004/0144009 A1 * 7/2004 Lee ..... F41A 17/46 42/70.06
2005/0011098 A1 * 1/2005 Fagundes de Campos ..... F41A 17/72 42/70.04
2005/0188582 A1 * 9/2005 Doiron ..... F41A 17/52 42/70.06
2009/0044438 A1 * 2/2009 Yollu ..... F41A 17/46 42/70.06
2009/0158634 A1 * 6/2009 Bubits ..... F41A 17/22 42/70.06
2010/0175292 A1 * 7/2010 Young ..... F41A 17/46 42/70.06
2010/0269391 A1 * 10/2010 Doll ..... F41A 17/58 42/70.05
2011/0219656 A1 * 9/2011 McGarry ..... F41A 15/16 42/70.06
2011/0308129 A1 * 12/2011 Tasyagan ..... F41A 17/56 42/70.06
2012/0090213 A1 * 4/2012 Pichler ..... F41A 17/46 42/70.06
2012/0117841 A1 * 5/2012 Joubert ..... F41A 19/10 42/69.01
2012/0291326 A1 * 11/2012 Bova ..... F41A 17/74 42/70.06
2013/0167423 A1 * 7/2013 Lupher ..... F41A 19/12 42/70.06
2013/0180394 A1 * 7/2013 Siddle ..... F41A 19/29 89/132
2016/0003569 A1 * 1/2016 Heizer ..... F41A 19/41 42/69.01
2016/0047613 A1 * 2/2016 Hudson, III ..... F41A 3/86 42/14
2016/0084599 A1 * 3/2016 Alicea, Jr. ..... F41A 17/46 42/70.06
2016/0084600 A1 * 3/2016 Siddle ..... F41A 19/31 42/69.01
2017/0059267 A1 * 3/2017 Hudson, III ..... F41A 19/12
2017/0108304 A1 * 4/2017 Heizer ..... F41A 17/46
2017/0268843 A1 * 9/2017 Heizer ..... F41A 11/00

* cited by examiner

FIREARMS TRIGGER ASSEMBLY

CROSS-REFERENCE TO RELATED APPLICATIONS

This application claims the benefit of U.S. provisional patent application Ser. No. 62/398,232, filed Sep. 22, 2016.

TECHNICAL FIELD

This disclosure relates generally to firearms and more particularly to a firearms trigger assembly.

BACKGROUND

The two most common types of triggers for firearms are (1) rotational; and (2) translational. A rotational trigger is generally considered safer because of the way it interacts with safety mechanisms, while a translational trigger has the advantages of a better "feel" or crispness in the action and also improved sighting. The improved sighting is due in part to the low amount of movement introduced on the sight picture during the shot process. Translational triggers, however, are considered less safe than rotational triggers because they are more likely to be prone to unintentional discharge from drop shock or occurrences which cause the safety mechanisms to fail.

There is an unmet need, therefore, for a translational trigger that preserves the feel of a traditional translational trigger while providing improved safety performance over traditional translational triggers.

SUMMARY

A firearms trigger assembly for a firearm having a yoked trigger with an integral safety includes a trigger piece, a safety cam pin, a trigger housing piece, and a trigger yoke to provide a crisp pull feel and good sighting while also providing reliable safety.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the following description and claims to refer to particular system components and method steps. As one skilled in the art will appreciate, different companies may refer to a component by different names. This document does not intend to distinguish between components that differ in name but not function.

Figure 1:
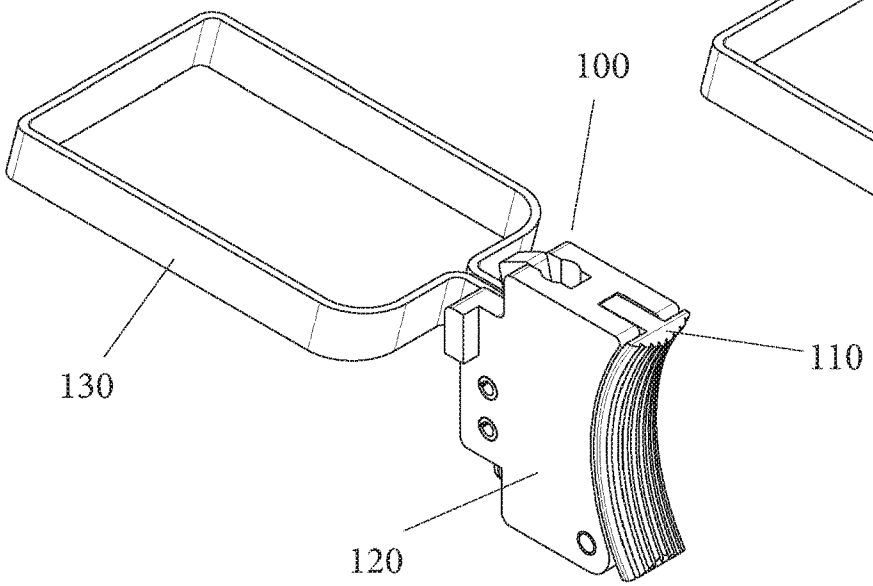
FIG. 1 is a perspective view diagrammatic illustration of a trigger assembly of the present invention.

Referring to FIG. 1 of the drawings, the reference numeral 100 generally designates a trigger assembly embodying features of the present disclosure. Trigger assembly 100 includes trigger safety 110, trigger housing piece 120, and trigger yoke 130 to form a yoked translational trigger having an integral safety.

Figure 2:
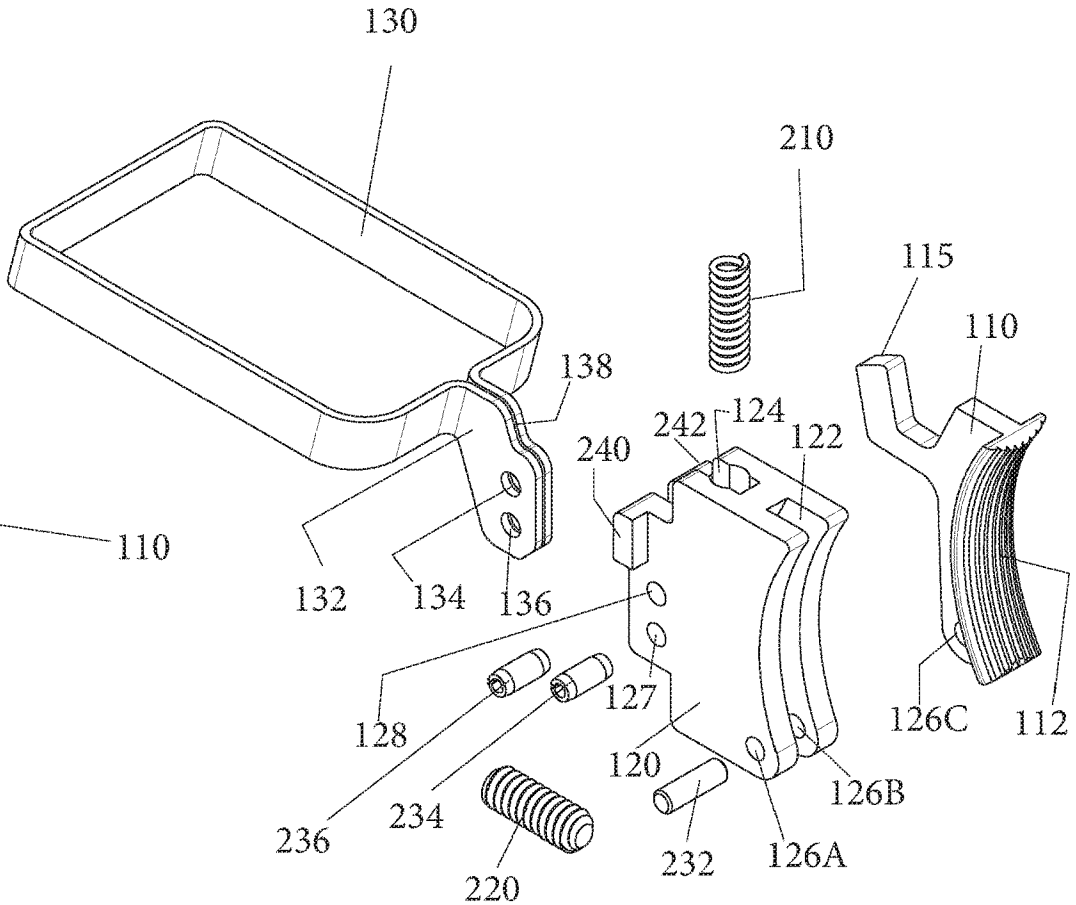
FIG. 2 is an exploded view diagrammatic illustration of the trigger assembly of FIG. 1.

FIG. 2 is an exploded view diagrammatic illustration of the trigger assembly of FIG. 1. Trigger housing 120 provides trigger piece receiving slot 122, receptacle 124 for receiving vertical spring 210, stops 240/242 and pin bores 126A and 126B, 127, and 128 to receive pins 232, 234, and 236, respectively, to connect trigger safety 110 to trigger housing piece 120 and trigger housing piece 120 to trigger yoke 130 at attachment portion 132 (see, FIG. 2). Additionally, set screw 220 is housed in trigger housing piece 120.

Trigger yoke 130 provides attachment portion 132 having pin bores 134, 136 to receive pins 236 and 234, respectively, and shoulder portion 138.

Trigger safety 110 has textured finger grip surface 112, cam 115 and pin bore 126C to receive pin 232.

Figure 3:
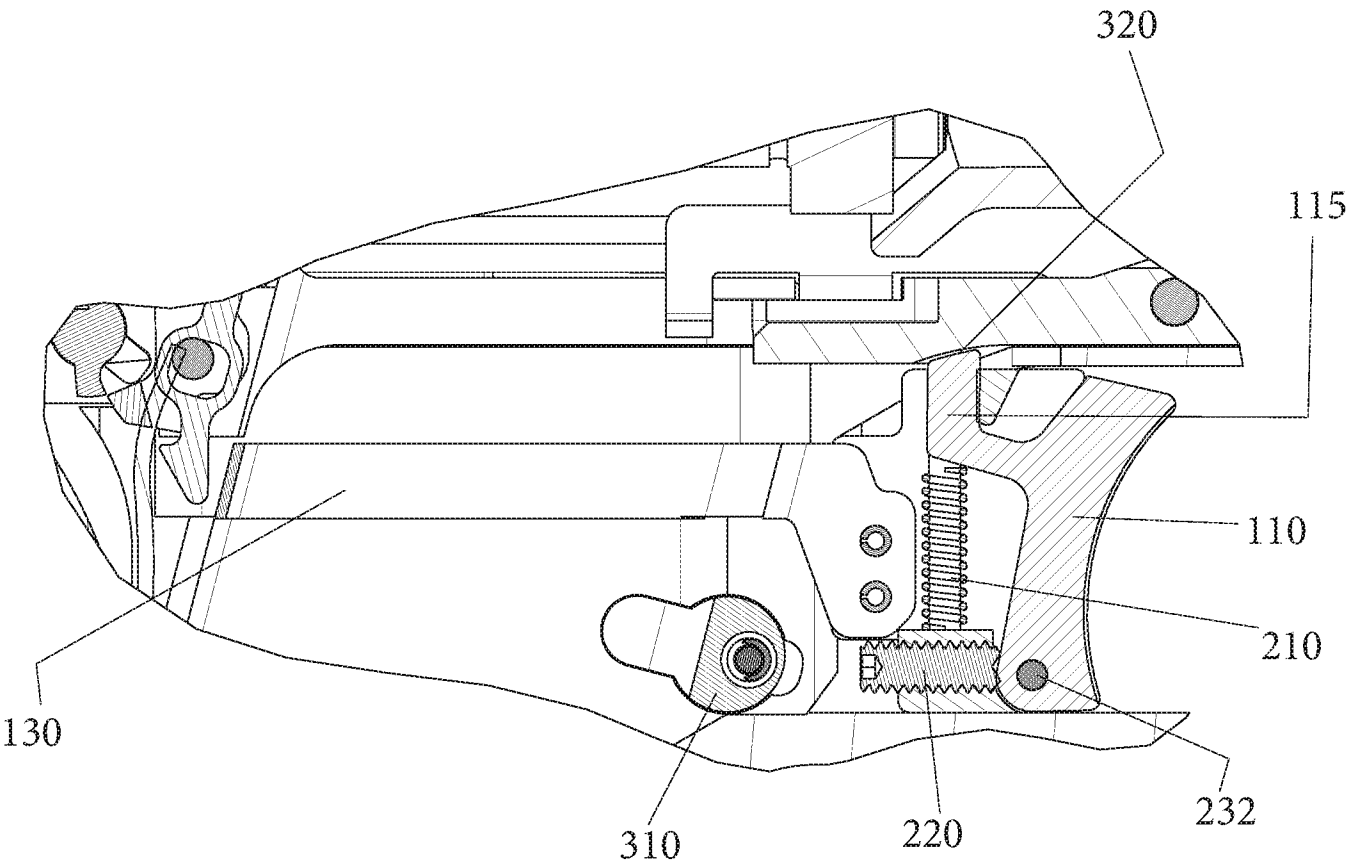
FIG. 3 is a side cross-section view detail of a firearm having a trigger assembly of the present invention.

FIG. 3 is a side cross-section view detail of a firearm having a trigger assembly of the present invention that operably interacts with the firearm housing or an insert of the firearm housing. Magazine release 310 is identified for orientation purposes located under trigger yoke 130. The firearm is at battery with has begun. Spring 210 biases cam 115 against surface 320 so that cam 115 of safety 110 is engaged with surface 320. Spring 210 is at full extension (minimum compression). Trigger yoke 130 is not engaged with fire control assembly 520 (see, FIG. 5).

Figure 4:
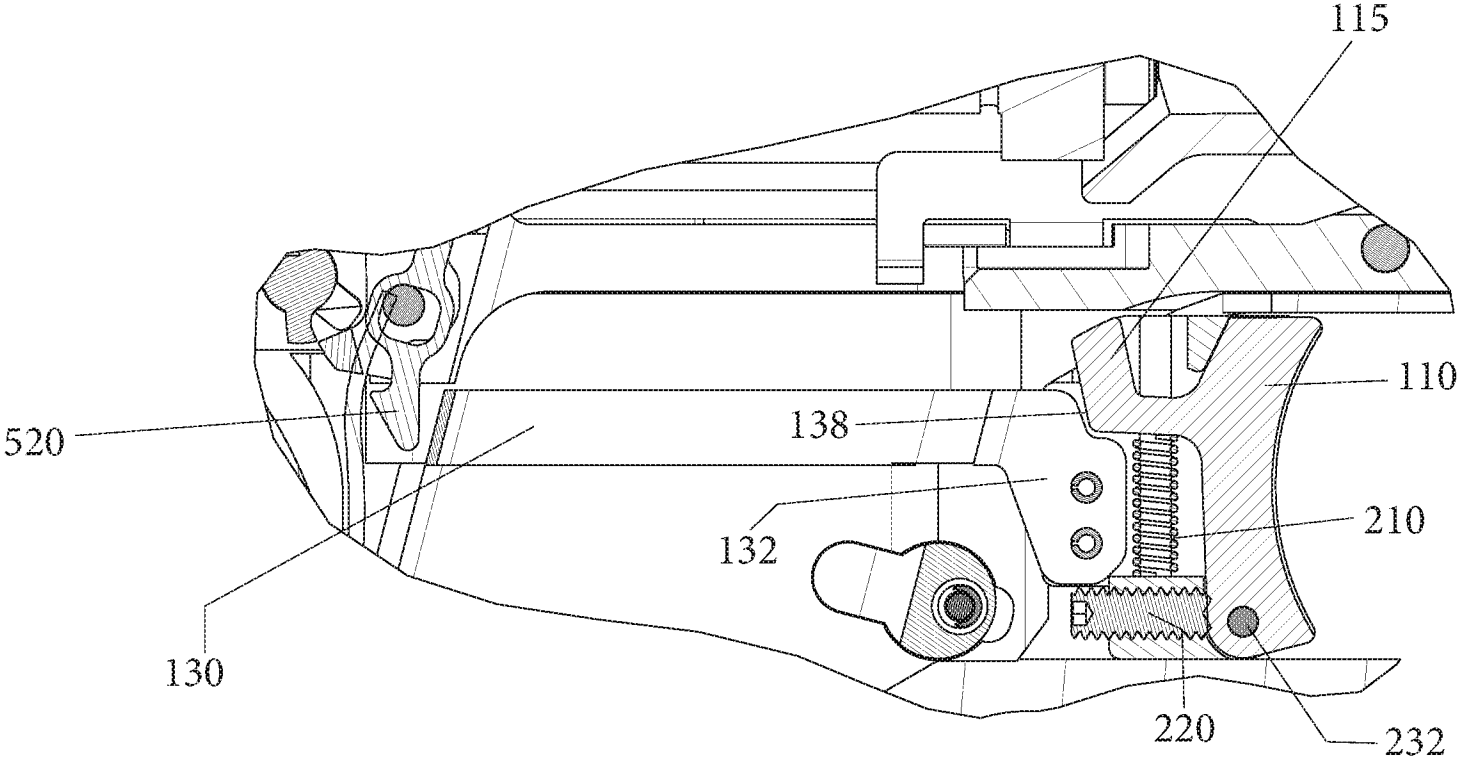
FIG. 4 is a side cross-section view detail of a firearm having the trigger assembly of FIG. 3 during trigger pull.

FIG. 4 is a side cross-section view detail of a firearm having the trigger assembly of FIG. 3 during trigger pull. Safety 110 is disengaged. Safety 110 pivots slightly forward about pin 232 compressing spring 210 downward and disengaging cam 115 from surface 320. The bottom surface of cam 115 mates with trigger yoke shoulder portion 138. Set screw 220 has not yet begun to translate with trigger assembly 100 toward firing assembly 520. As trigger assembly 100 is pulled translationally, cam 115 disengages from surface 320 to allow trigger yoke 130 to translate unimpeded toward fire control assembly 520. Cam 115 engages trigger yoke shoulder portion 138 and pushes trigger yoke 130 toward fire control assembly 520.

Figure 5:
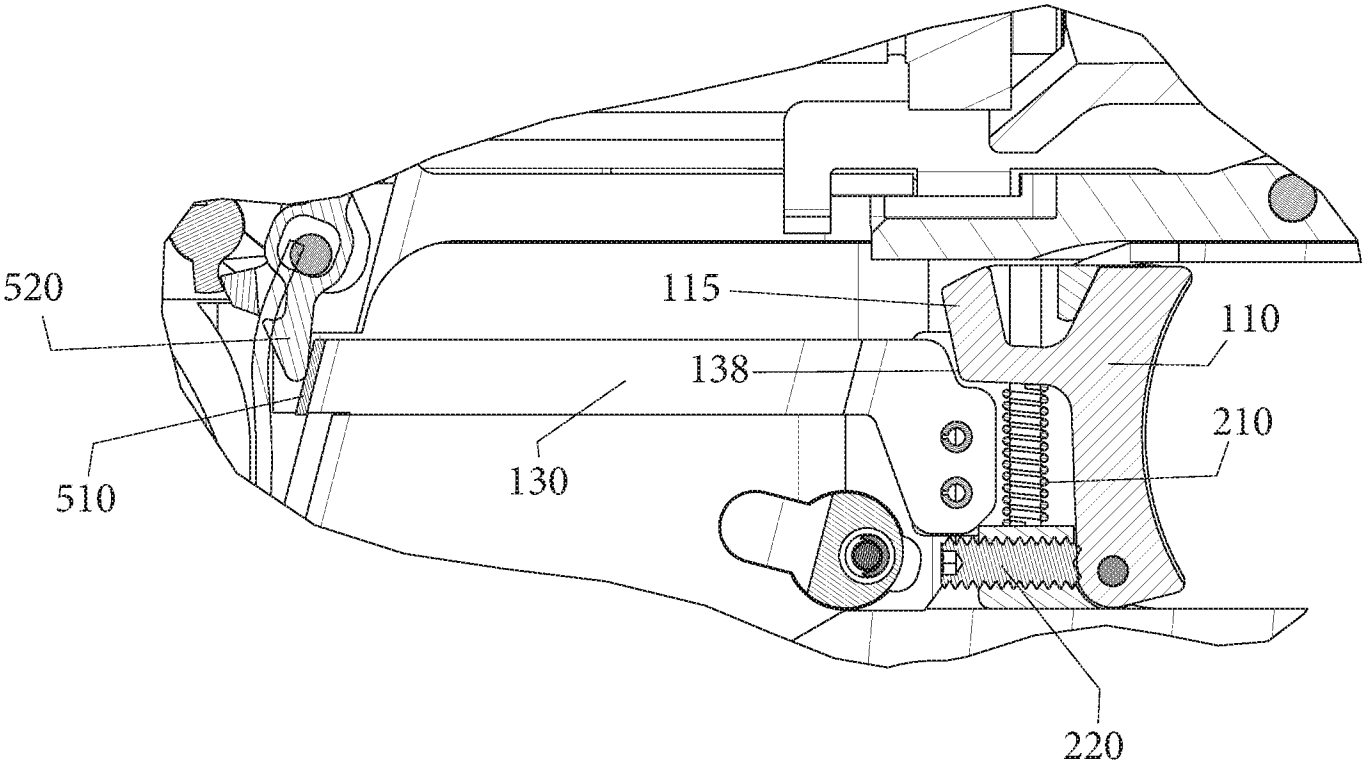
FIG. 5 is a side cross-section view detail of a firearm having the trigger assembly of FIG. 4 during a later stage of trigger pull.

FIG. 5 is a side cross-section view detail of a firearm having the trigger assembly of FIG. 4 during a later stage of trigger pull. Trigger yoke 130 translates straight back toward and engages fire control assembly 520 at surface 510. Set screw 220 translates with trigger safety 110 as trigger assembly 100 moves translationally toward fire control assembly 520.

The use of a firearms trigger assembly of the present disclosure provides many advantages over the prior art including reducing the need for other redundant safety systems that complicate the firearm design. It allows a proven design to be used in the new context of a translational trigger system. Other translational trigger systems contain multiple manual systems, something that rotational triggers overcame by including the safety in the trigger itself. This allows the firearm to be safe when not in use.

The traditional firearms that utilize a translational trigger system either incorporated multiple manual safeties (i.e., for example, backstrap (grip) safety and thumb safeties) or they utilized a system of gears to actuate a drop safety (which affected the trigger feel). These types of safeties are found in traditional 1911 designs and the series 80 Colt™ designs.

Traditional rotational triggers use an integrated trigger safety that is biased against a ledge in the grip and utilize a cam on the trigger bar to disengage the drop safety. This is relatively easy to do by using the front rotation and an attached trigger bar to accomplish it, as is the case with Glock™ and Smith and Wesson™ M&P™s.

The arrangement of the grip/insert construction of the present invention creates a safety arrangement that occurs at the front of a translational trigger without affecting the feel of the trigger pull. This geometry would be nearly impossible to create without the insert construction inherent in the design that creates surface 320.

Many modifications and other embodiments of the firearms trigger assembly described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A translational trigger assembly for a firearm, the translational trigger assembly comprising:

a trigger housing having a trigger piece receiving slot and a receptacle;

a trigger safety at least partially disposed within the trigger piece receiving slot and pivotally attached to the trigger housing about a bottom of the trigger housing such that an upper portion of the trigger safety rotates rearward when the trigger safety is pulled, wherein the trigger safety comprises a cam;

a trigger yoke connected to the trigger housing, wherein the cam is configured to rotate rearward and engage the trigger yoke to cause the trigger yoke to translate linearly rearward towards a fire control assembly when the trigger safety is pulled; and a spring disposed in the receptacle and configured to bias the cam away from the trigger yoke.

2. The translational trigger assembly of claim 1, wherein the trigger housing and trigger safety comprise pin bores disposed about the bottom of the trigger housing and a bottom of the trigger safety, and wherein a pin is disposed through the pin bores.

3. The translational trigger assembly of claim 1, further comprising a setscrew disposed within the trigger housing and configured to translate rearward with the trigger safety towards the fire control assembly when the trigger safety is pulled.

* * * * *